US006886791B2

(12) United States Patent
Dettorre

(10) Patent No.: US 6,886,791 B2
(45) Date of Patent: May 3, 2005

(54) DOUBLE HOOK SPORTS BOARD WALL HANGER SYSTEM

(76) Inventor: Ross D. Dettorre, 2598 Wandering Ridge, Chino Hills, CA (US) 91709

( * ) Notice: Subject to any disclaimer, the term of this patent is extended or adjusted under 35 U.S.C. 154(b) by 0 days.

(21) Appl. No.: 10/172,115

(22) Filed: Jun. 13, 2002

(65) Prior Publication Data

US 2002/0190169 A1 Dec. 19, 2002

Related U.S. Application Data

(60) Provisional application No. 60/297,921, filed on Jun. 13, 2001.

(51) Int. Cl.[7] ..... F16M 11/00

(52) U.S. Cl. ..... 248/201; 248/307; 211/85.7; 211/94.01

(58) Field of Search ..... 211/85.7, 94.01, 211/87.01, 105.1, 106.01; 248/201, 215, 304, 307

(56) References Cited

U.S. PATENT DOCUMENTS 1,897,248 A * 2/1933 Ferguson ..... 248/214
1,930,965 A * 10/1933 Christy ..... 16/87.2
3,645,485 A * 2/1972 Gold ..... 206/459.5
3,701,436 A * 10/1972 Adams ..... 114/364
4,658,967 A * 4/1987 Wang ..... 211/182
4,946,727 A * 8/1990 Kessler ..... 24/297
5,027,960 A * 7/1991 Rainville ..... 211/118
5,078,347 A * 1/1992 Sharpe ..... 248/59
5,082,123 A * 1/1992 Lamb ..... 211/18
5,097,968 A * 3/1992 Gregory ..... 206/338
D365,236 S * 12/1995 Stockwell ..... D6/513
5,740,994 A * 4/1998 Laughlin ..... 248/58
5,799,915 A * 9/1998 Morey ..... 248/201
5,833,079 A * 11/1998 Roberts ..... 211/105.1
5,867,874 A * 2/1999 Simpson ..... 24/10 R
5,950,844 A * 9/1999 Taylor ..... 211/118
6,045,100 A * 4/2000 Shields ..... 211/85.7
6,053,340 A * 4/2000 Cameron ..... 211/75
6,055,755 A * 5/2000 Prokes ..... 248/303

* cited by examiner

*Primary Examiner*—Korie Chan
(74) *Attorney, Agent, or Firm*—Donald W. Meeker

(57) ABSTRACT

A pair of hangers with padded tapering openings are attachable to a wall in a horizontal alignment to support a sports board therebetween. A spacer mount maintains the opening away from the wall to prevent contact of the board with the wall surface. Padding may be adhered to the sides of the tapered opening or molded on the surfaces. A strap may hang down from each of the pair of hangers with an adjustable loop formed in the strap to hang additional boards. The strap may clip into the hanger with the strap looped over the clip or molded to the clip during the molding process. The strap has a pad on the back side to keep the board in the loop from contacting the wall. A horizontal rail with a front slot may be attached to the wall and the pair of hangers fit adjustably along the rail.

17 Claims, 4 Drawing Sheets

DOUBLE HOOK SPORTS BOARD WALL HANGER SYSTEM

CLAIM OF PROVISIONAL APPLICATION RIGHTS

This application claims the benefit of U.S. Provisional Patent Application No. 60/297,921, filed on Jun. 13, 2001.

BACKGROUND OF THE INVENTION

1. Field of the Invention

The present invention relates to wall hangers for extreme recreational sports boards and, in particular, to a wall hanger system with a pair of spaced hooks mounted adjustably on a wall rail with spacers to maintain the boards away from the surface of the wall, and, additional padded hanging straps with loops for retaining additional boards away from the wall surface especially adapted for surfboards, wakeboards, snowboards, and skateboards.

2. Description of the Prior Art

Storage and display are always problems in any home or business. There never seems to be enough space to store everything in a way that makes access easy for retrieving the stored items.

Some items which are used constantly or having particular meaning or attractive appearance are desirable to store in visible locations with very easy access. Surfboards, wakeboards, snowboards and skate boards fall into all of these categories for avid users of these devices.

Wall storage can be a good solution for items such as these. The items stored on the wall are highly visible and easily accessible. To preserve space, it is desirable to store the boards flat against the wall so that the boards do not stick out, away from the wall. This wall proximity can result in the damage or marring of either the wall or the boards, especially when these recreational devices are used outdoors and are likely to have dirt, tar or other matter on the surface of the boards that would make hard to remove spots on the wall, if the boards came into contact with the wall surface.

Another problem is the board itself, which is often made of somewhat soft material, subject to denting and scratching. Storing the boards in a support system which does not scratch or dent or mar the surface of the board is desirable.

Some attempts have been made at wall storage for various types of boards. None have solved the problem of providing a simple, inexpensive wall hanging hook for hanging a board which will, at the same time, keep the board from contacting the wall.

U.S. Pat. No. 5,799,915, issued Sep. 1, 1998 to Morey, provides wall-mounted brackets for snowboards having a U-shaped configuration to support the board between two brackets. The Morey patent differs in that the outer plate of the bracket pivots open and closed and a top bracket is also used to secure the other edge of the board stored horizontally on the brackets. The brackets lack the features allowing storage of a broad range of boards and fail to provide padding for the soft resin surface of surfboards.

U.S. Pat. No. 5,082,123, issued Jan. 21, 1992 to Lamb, shows a pair of wall-mounted brackets for surfboards or sailboards, as well as bicycles and other sports apparatus. While the brackets angle out from the wall, there is no tapered opening to accommodate different sizes of boards. There is no padding provided for soft boards.

U.S. Pat. No. 5,833,079, issued Nov. 10, 1998 to Roberts, shows a surfboard (snowboard, skateboard, wakeboard, water ski, and snow ski) rack having two spaced apart wall-mounted bases each having two outwardly angled pegs attached for holding two boards. The pegs are covered with rope or foam or other material to accommodate the soft surface of surf boards. There is no retaining tapered opening to accommodate different size boards. Because of the almost horizontal angle, the boards would stick out quite a ways from the wall.

U.S. Pat. No. 3,701,436, issued Oct. 31, 1972 to Adams, claims a water ski (or snow ski or other equipment) rack having two spaced apart brackets angled outwardly. The rack mounts to a boat or land vehicle and has two slots in each bracket and tie-down straps. Each bracket is plugged into a socket with a spring clip for easy insertion and removal. No padding is provided for soft board surfaces and no angled opening for various board sizes.

U.S. Pat. No. 4,911,310, issued Mar. 27, 1990 to Raishe and U.S. Pat. No. 4,735,325, issued Apr. 5, 1988 to Remmers, both show holders somewhat similar in shape to those of the present invention, but for entirely different purposes. Neither has a tapered opening or padding.

None of the patents found provide a wall-mounted pair of hangers which are adequately spaced from the wall to accommodate the flip or kick tail of a skateboard. None provide an angled slot to accommodate different board sizes. Only one provides padding, but it lacks all of the other features.

SUMMARY OF THE INVENTION

An object of the present invention is to provide a hanger, soft-support, and spacer for a surfboard, wakeboard, snowboard, skateboard or other board-type device for wall-mounting by placing any of the boards on a pair of hooks mounted to the wall. The hooks are tapered, padded and spaced apart from each other and the wall to maintain distance away from the wall and to provide a soft resting place for the boards.

A related object of the present invention is to provide tapered hooks to hold the boards securely and enable a wide range of types and sizes of boards to be used in the hooks with the taper accommodating different sizes and shapes of edges of the boards, which fit into the tapered, spaced-apart pair of hooks.

Another object of the present invention is to provide a wall-mounting hook that is easy and inexpensive to manufacture in a single piece by an injection molding process. Two identical pieces are used together to support the boards.

A further object of the present invention is to provide a hanger and spacer that is injection molded, using a plastic resin mixed with dyes to match the colors of the boards, especially appealing for a retail display which sells the boards.

A related object of the present invention is to provide a double hanger and spacer with a flat plate wall-mount base that has ample flat space, and, an extending hook with an ample flat space for an advertisement, insignia, logo, design, personal statement or other type of visual display.

A corollary object of the present invention is to provide a horizontal rail with a slot for mounting a series of hooks adjustably along the rail in a horizontal array. The rail has flat spaces in an end piece and a connector for an advertisement, insignia, logo, design, personal statement or other type of visual display.

An additional object of the present invention is to provide a rail with a slidable groove to accommodate a quickly mountable, movable array of hooks which wall-mount boards.

Again, another object of the present invention is to provide strap loops which will snap fit into the wall-mounted hooks, and hang down from those hooks to hold additional boards, skis or other long objects below the wall-mounted hooks and rail and between the pair of hooks with hanging loops.

In brief, a pair of spaced apart wall-mountable hook elements attach adjustably to a wall, or preferably on the wall rail described herein, with a padded hook mounted on a spacer sufficiently far from the wall, to allow the boards to rest in the padded hooks without the fins or any other parts of the boards touching the wall surface.

The compact pair of identical hangers with hooks mounted on spacers can be easily and inexpensively manufactured from a single mold, using injection molding techniques.

A rail with a sliding track enables the quick and easy mounting of a number of hangers aligned in a movable array on the wall.

Advertising space, or space for other types of images, is provided on the flat plate and outward portion of the hook part of the hangers and on the connectors and end pieces of the horizontal rail.

An advantage of the present invention is that it presents a simple solution to the problem of storage and/or display of recreational boards using a small pair of wall-mounted hangers with hooks, mounted on spacers and, an additional rail for mounting a number of the hangers.

Another advantage of the present invention is that it protects the wall from marks or damage from the wheels or other parts of the boards with a minimal hanging element which does not take up much wall space.

A further advantage of the present invention is that it provides an attractive display means for showing boards for sale with several advertising spaces on the hanger and rail.

One more advantage of the present invention is that it provides a soft padded cradle in the hooks for receiving and storing boards without marring the boards.

Another major advantage is that the present invention provides tapered hooks which can accommodate a wide variety of sizes and shapes of boards.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1–5, a double hook wall hanger system attaches to a wall for mounting a wide range of types and sizes of recreational boards to a wall while maintaining the boards away from contact with the wall.

Figure 3:
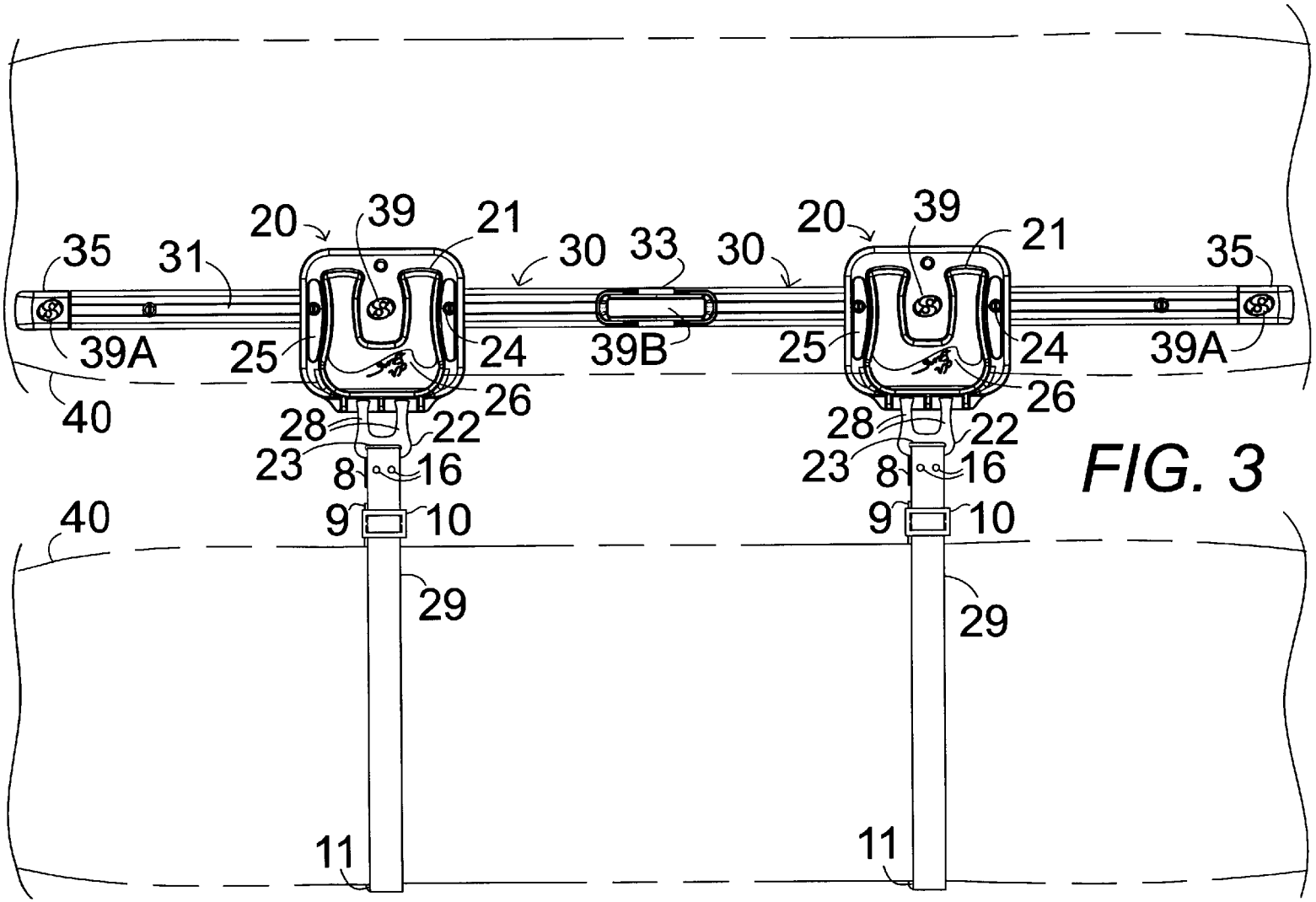
FIG. 3 is a front elevational view of a pair of hangers spaced apart and mounted on the wall rail with the hangers holding a board and an additional pair of looped straps attached to the hangers supporting another board.

A pair of hangers 20 and 20A mount on a wall by a mounting means, such as a horizontal rail 30. Each of the hangers is comprised of a spacer mount 25 attached to the wall or the rail 30 by a screw means. A hook element, such as the U-shaped hook 21 or single arm hook 21A, attaches at the bottom of the spacer mount 25, and angles away from the spacer mount 25, creating a tapered board opening 12 therebetween, capable of receiving any number of a variety of sizes and types of recreational sports boards 40. The tapered board opening 12, (as seen in FIG. 3) allows a recreational sports board 40 placed in the opening to be secure by a friction fit, in contact with at least one surface bordering the tapered opening 12. The board 40 is spaced apart from contact with the wall by the spacer mount 25 and by an outwardly leaning angle of the board created by the hook element, such as the U-shaped hook 21.

In FIGS. 1, 2, 4 and 5, a padding means, such as a matching U-shaped pad 19 for the U-shaped hook element 21 and, a singular elongated pad 19A for the singular hook element 21A, covers at least one surface bordering the tapered opening 12 to cushion a board placed in the board opening. Alternately, the padding means may be a molded rubberized surface 14 molded to the surface of the spacer mount 25A, (as in FIG. 5) bordering the tapered opening 12 or to the hook element 21 and 21A.

The hook element 20 and 20A also possesses a flat exposed front surface 26 for visual displays.

Figure 1:
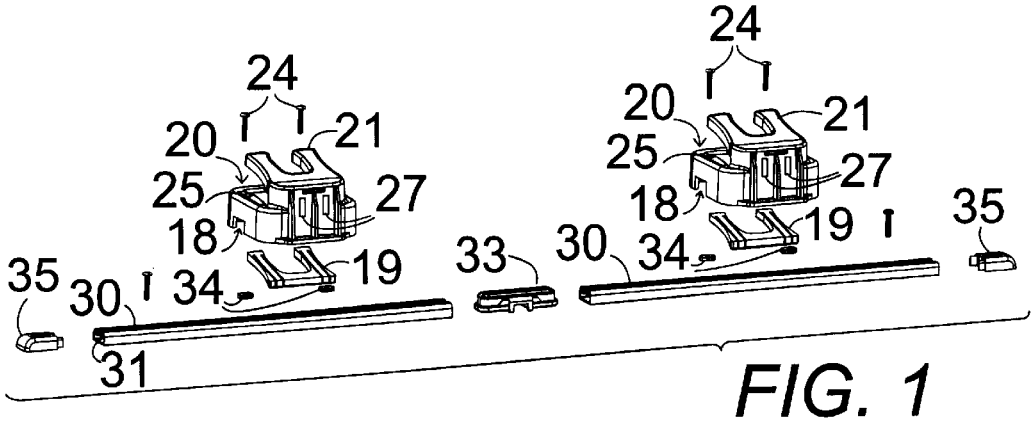
FIG. 1 is a perspective view of the pair of hangers with U-shaped hooks mounted on spacers and U-shaped pads for the hooks and related fasteners aligned for mounting on a wall rail with a sliding groove.
Figure 4:
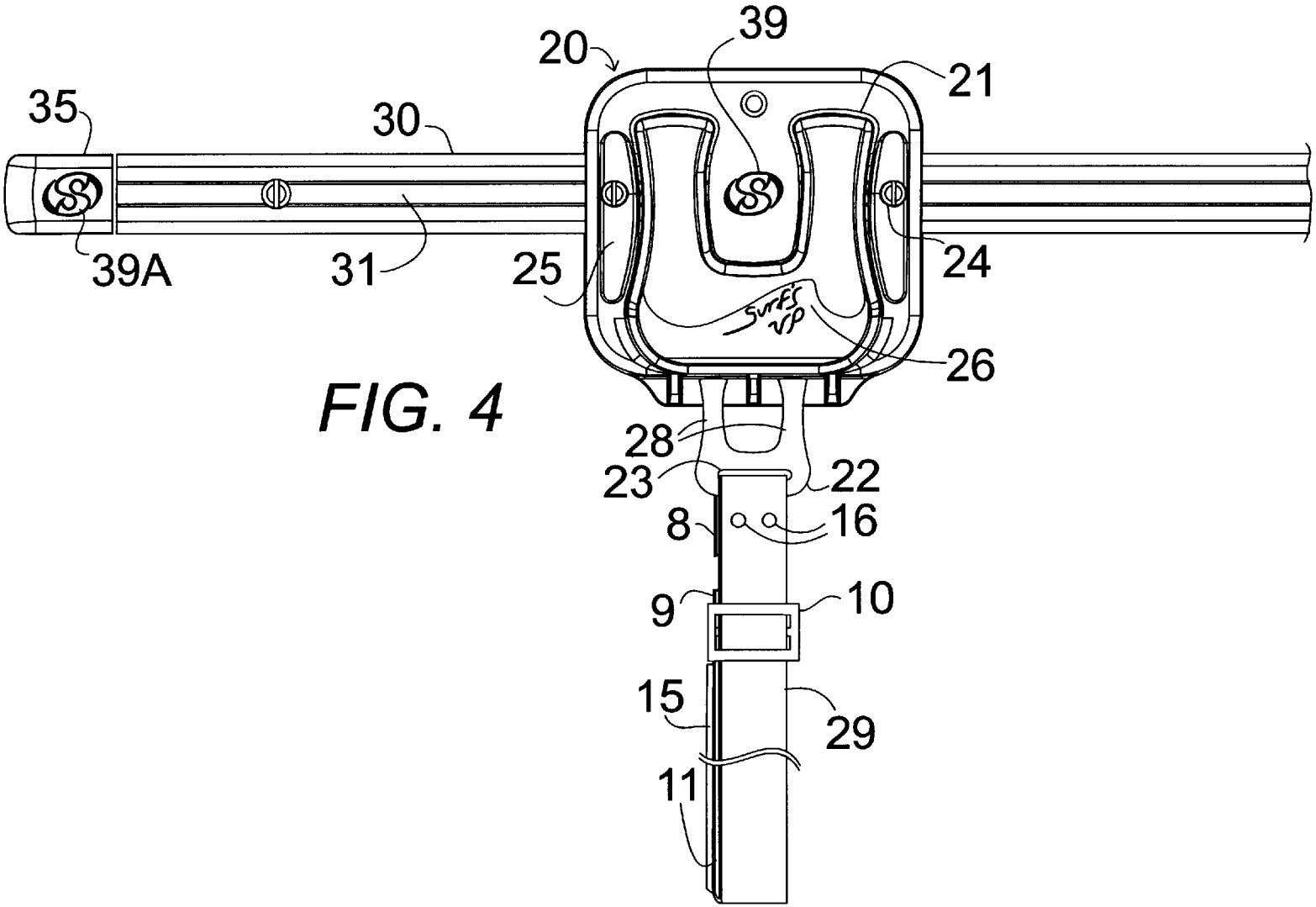
FIG. 4 is an enlarged front elevational view of one of the hangers of FIG. 3.

In FIGS. 1, 3 and 4, the mounting means is comprised of an elongated rail 30 horizontally mountable on a wall by screws or other wall-mounting means. The rail 30 has a track 31 along its length for receiving at least one slidable element, such as threaded washers 34 and screws 24 from each of the pair of hangers 20. The slidable element is capable of sliding within the track, and supporting and permitting horizontal adjustment of the pair of hangers 20 on the rail 30.

In FIGS. 1 and 3, the rail 30 may be extended to any desired length by using interconnectors 33 which snap into the sections of elongated rails 30. The interconnector 33 has a flat exposed front surface 39B, in FIG. 3, for visual displays.

In FIGS. 1, 3 and 4, a pair of end caps 35 snap-fit into each end of the elongated rail 30. The end caps 35 are each provided with a flat exposed surface 39A, in FIG. 3, for visual displays.

Figure 2:
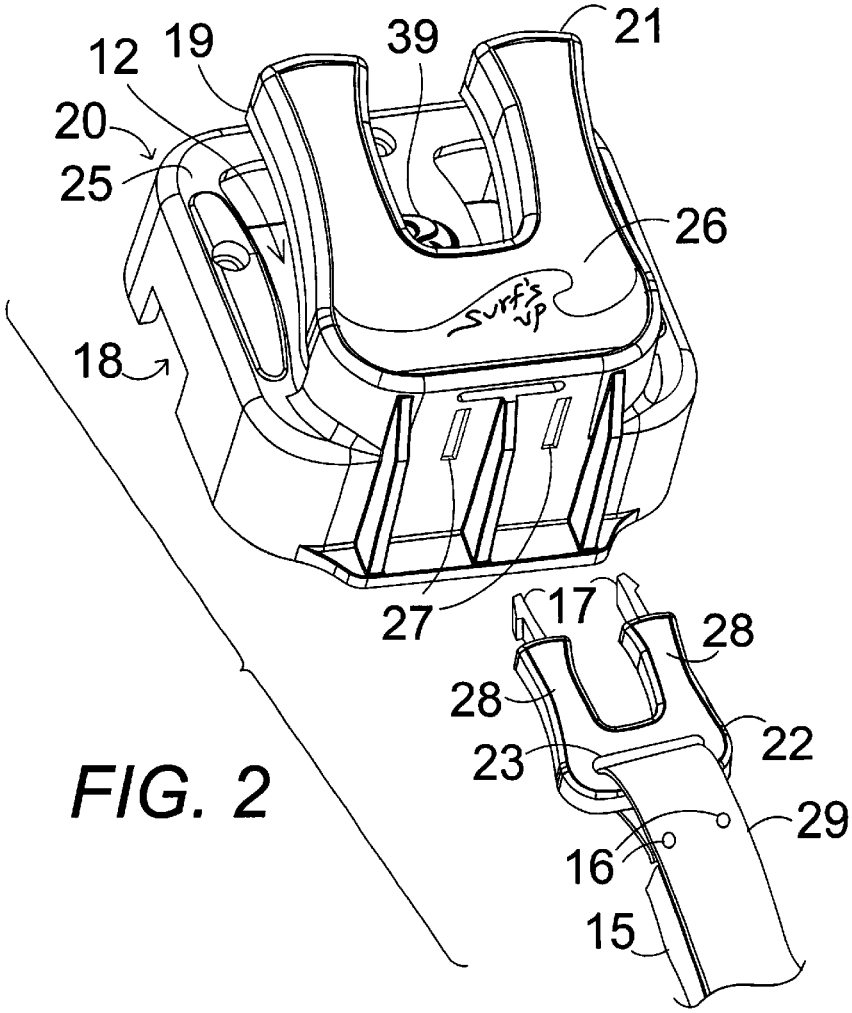
FIG. 2 is a perspective view of one of the pair of hangers with a U-shaped hook and an additional connector with a looped strap and snap fit connector for attaching to the hanger to hang additional boards.
Figure 5:
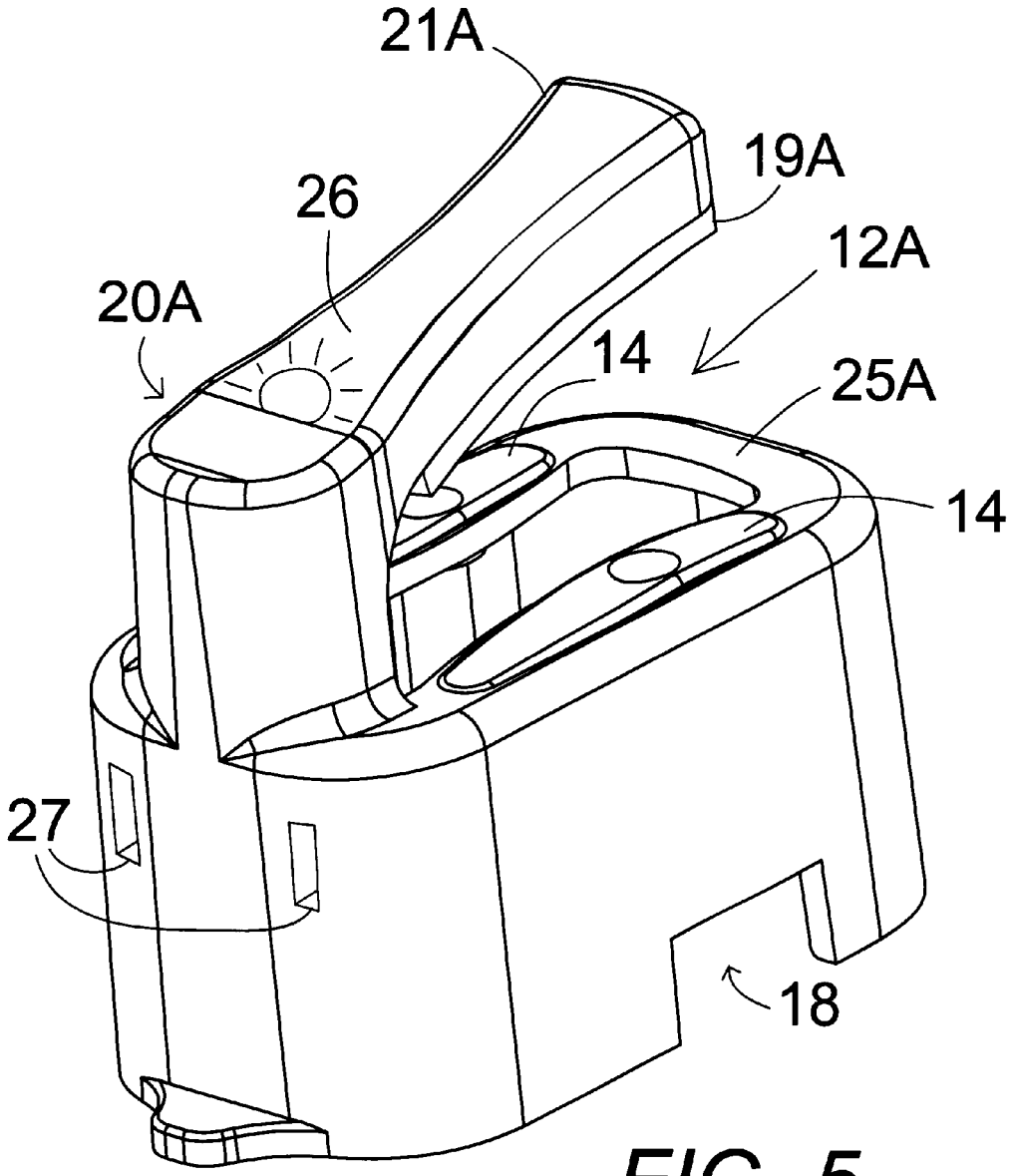
FIG. 5 is a perspective view of an alternate hanger having a one armed hook mounted on a spacer with a wider gap between the hook and the spacer for hanging surfboards and skateboards.

In FIGS. 1, 2 and 5, the spacer mount 25 has a rail receiving opening 18 horizontally oriented across the width of the spacer mount 25, on its side adjacent to the wall, so that the spacer mount 25 fits over the horizontal rail 30 and contacts the wall for added stability.

In FIG. 2 the tapered opening 12 is configured to receive any of a variety of types and sizes of snowboards and wakeboards, such as board 40 shown in FIG. 3.

In FIG. 5, an alternate embodiment of the pair of hangers 20A has the tapered opening 12A configured to receive any of a variety of types and sizes of surfboards and skateboards.

In FIGS. 2–4, a cordlike element, such as a nylon strap 29 is suspended from each of the pair of hangers 20. Each of the nylon straps 29 has a loop 11 configured in the nylon strap by an overlapping end 9 of the strap engaging a midsection of the strap by an adjustable means, such as a belt-type strap adjuster 10 to create an adjustable size loop for receiving various types and sizes of boards such as the board 40 in FIG. 3, as an additional board. The nylon strap 29 attaches to each of the pair of hangers 20 by a clip 22 snap-fit by a pair of flexible snap hooks 17 which fit into a pair of mating slots 27 in the bottom of each of the pair of hangers 20 and 20A. A strap pad 15 runs the length of the loop 11 of the strap 29 to maintain the board 40 hanging in the loop 11 away from the wall surface.

In FIGS. 2–4, the cordlike element 29 attaches to each of the clips 22 by having a connecting end 8 of the strap fit through a slot 23 in the clip 22 and connect back on itself by rivets 16 or sewing or other connecting means to form a premanent loop through the clip. Alternately the strap 29 may connect to each of the clips 22 by having an end of the cordlike element molded into each of the clips 22.

The pair of hangers 20, 20A and the rail 30 are fabricated of injection-molded resin plastic, mixed with colored dyes and possibly metal flakes for attractive, colorful hangers and rails which may match the colors and designs on the various recreational sports boards being hung.

It is understood that the preceding description is given merely by way of illustration and not in limitation of the invention and that various modifications may be made thereto without departing from the spirit of the invention as claimed.

What is claimed is:

1. A double hook wall hanger system for mounting a wide range of types and sizes of recreational boards on a wall while maintaining the boards away from contact with the wall, the system comprising:

a mounting means, a pair of hangers mounted on a wall by said mounting means adapted to receive the pair of hangers slidably mounted thereon to enable the pair of hangers to be spaced apart by a desired distance to accommodate boards of various lengths, each of the hangers comprising a spacer mount slidably attached to the mounting means, a hook element attached at a bottom of the spacer mount and angled away from the spacer mount creating a tapered board opening therebetween capable of receiving a variety of sizes and types of recreational sports boards in the tapered board opening so that a board placed in the board opening is secured with a friction fit in contact with at least one surface bordering the tapered opening, the board being spaced apart from contact with the wall;

wherein each of the hangers is sufficiently compact and the spacer mount has a spacer mount opening therethrough directly opposite to the hook element, the spacer mount opening having an opening outline in a shape and size of the hook element so that the hanger is adapted to be manufactured from a single mold using injection molding techniques to form each single one-piece hanger; and a padding means covering a surface of the spacer mount bordering the tapered opening on each side of the spacer mount opening and covering an inside surface of the hook element bordering the tapered opening to cushion a board placed in the board opening.

2. The wall hanger system of claim 1 wherein the hook element further comprises a flat exposed surface for visual displays.

3. The wall hanger system of claim 1 wherein the mounting means comprises an elongated rail mountable horizontally on the wall by a wall-mounting means, the rail having a track along its length for receiving at least one slidable element from each of the pair of hangers, the slidable element capable of sliding within the track and supporting and permitting horizontal adjustment of the pair of hangers on the rail.

4. The wall hanger system of claim 3 wherein the elongated rail comprises at least two sections having mating ends, and further comprising at least one interconnector which snap fits into the mating ends of the at least two sections of elongated rails.

5. The wall hanger system of claim 4 wherein the interconnector further comprises a flat exposed surface for visual displays.

6. The wall hanger system of claim 3 further comprising a pair of end caps which snap fit into each end of the elongated rail, the end caps each provided with a flat exposed surface for visual displays.

7. The wall hanger system of claim 3 wherein the spacer mount has a rail receiving opening horizontally oriented across the width of the spacer mount on a side of the spacer mount adjacent to the wall so that the spacer mount fits over the horizontal rail and contacts the wall for added stability.

8. The wall hanger system of claim 1 wherein the padding means comprises a flexible pad attached to an inside surface of the hook bordering the tapered opening.

9. The wall hanger system of claim 1 wherein the padding means comprises a molded rubberized surface molded to said inside surface of the hook bordering the tapered opening.

10. The wall hanger system of claim 1 wherein the padding means comprises a molded rubberized surface molded to said surface of the spacer mount bordering the tapered opening.

11. The wall hanger system of claim 1 wherein the tapered opening is configured to receive a variety of types and sizes of surfboards and skateboards.

12. The wall hanger system of claim 1 wherein the tapered opening is configured to receive a variety of types and sizes of snowboards and wakeboards.

13. The wall hanger system of claim 1 further comprising a cordlike element suspended from each of the pair of hangers, each of the cordlike elements having a loop configured in the cordlike element for supporting an additional board between the two cordlike elements.

14. The wall hanger system of claim 13 wherein the cordlike element attaches to each of the pair of hangers by a clip snap fit into each of the pair of hangers.

15. The wall hanger system of claim 13 wherein the cordlike element attaches to each of the pair of hangers by having an end of the cordlike element molded into a clip which snap fits into each of the pair of hangers.

16. The wall hanger system of claim 13 wherein the cordlike element comprises a strap having a sliding buckle attaching an end of the strap to a mid portion of the strap thereby enabling the strap to form an adjustable loop to accommodate variously sized and shaped boards in the loop.

17. The wall hanger system of claim 1 wherein the pair of hangers and the rail are fabricated of injection molded resin plastic mixed with colored dyes.

* * * * *